US011898559B2

(12) United States Patent
Shoemaker et al.

(10) Patent No.: US 11,898,559 B2
(45) Date of Patent: Feb. 13, 2024

(54) GEAR PUMP WITH COOLED JOURNAL BEARINGS

(71) Applicant: Hamilton Sundstrand Corporation, Charlotte, NC (US)

(72) Inventors: Mark W. Shoemaker, Pecatonica, IL (US); Zachary Allen Ray Le Duc, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 30 days.

(21) Appl. No.: 17/507,498

(22) Filed: Oct. 21, 2021

(65) Prior Publication Data

US 2023/0127244 A1 Apr. 27, 2023

(51) Int. Cl.
*F01C 21/06* (2006.01)
*F03C 2/00* (2006.01)
(Continued)

(52) U.S. Cl.
CPC ..... *F04C 2/084* (2013.01); *F04C 15/0026* (2013.01); *F04C 15/0096* (2013.01); *F04C 2240/50* (2013.01); *F04C 2240/60* (2013.01)

(58) Field of Classification Search
CPC ..... F04C 2/084; F04C 2/16; F04C 15/0026; F04C 15/0096; F04C 2240/50; F04C 2240/56; F04C 2240/60; F16C 37/00; F16C 37/002; F16C 37/007; F28D 15/02; F28D 15/04; F28D 15/046; F28D 15/0266;
(Continued)

(56) References Cited

U.S. PATENT DOCUMENTS 5,292,237 A * 3/1994 Orimo ..... F04C 15/0096 418/94
5,924,854 A 7/1999 Blume et al.
(Continued)

FOREIGN PATENT DOCUMENTS

| | | | |
|---|---|---|---|
| GB | 1149279 | A | 4/1969 |
| JP | S61226583 | A | 10/1986 |
| WO | 2006087208 | A1 | 8/2006 |

OTHER PUBLICATIONS

WO2006087208 (A1)—Alexander et al.—Gear Pump—Aug. 24, 2006—English Machine Translation. (Year: 2006).*
(Continued)

*Primary Examiner* — Theresa Trieu
(74) *Attorney, Agent, or Firm* — Carlson, Gaskey & Olds, P.C.

(57) ABSTRACT

A gear pump includes gears received within a housing defining an inlet, an outlet and end plates. The gears have shaft portions on each of two sides of each of the two gears. The shaft portions are mounted in journal bearings. The journal bearings each have a gear side face adjacent one of the two gears. A remote face is on a remote side of the journal bearing remote from each of the two gears. There is a plurality of heat pipes in at least one of the journal bearings. The heat pipes move heat from the gear face of the at least one of the journal bearings to the remote face. The plurality of heat pipes is enclosed by the housing, and extend generally in an axial direction from an end adjacent the gear face to an end adjacent the remote face. A fuel supply system is also disclosed.

8 Claims, 3 Drawing Sheets

(51) Int. Cl.

| | |
|---|---|
| ***F03C 4/00*** | (2006.01) |
| ***F04C 2/08*** | (2006.01) |
| ***F04C 15/00*** | (2006.01) |

(58) Field of Classification Search
CPC ..... F28D 2015/0216; F28D 2015/0225; F28D 2021/0028
See application file for complete search history.

(56) References Cited

U.S. PATENT DOCUMENTS

| | | | | |
|---|---|---|---|---|
| 6,210,042 | B1 | 4/2001 | Wang et al. | |
| 6,761,546 | B2 | 7/2004 | Schlipf et al. | |
| 7,168,480 | B2 * | 1/2007 | Jankowski | F28D 15/046 165/104.26 |
| 2001/0031214 | A1 * | 10/2001 | Haavik | F04C 29/04 418/85 |
| 2003/0147765 | A1 * | 8/2003 | Schlipf | F01C 21/02 418/206.7 |
| 2017/0198694 | A1 * | 7/2017 | Ribarov | F04C 2/088 |

OTHER PUBLICATIONS

European Search Report for EP Application No. 22201423.5 dated Mar. 29, 2023.

* cited by examiner

GEAR PUMP WITH COOLED JOURNAL BEARINGS

BACKGROUND OF THE INVENTION

This application relates to a gear pump having gears mounted in journal bearings with cooling to transfer heat from a gear face of the journal bearings to a remote face of the journal bearings.

Gears pumps are known, and typically include a pair of gears having teeth which are engaged with each other. One of the gears is typically driven by a motor or other source of rotation, and causes the other gear to rotate through the engagement of its gear teeth. As the two rotate in opposed directions, a fluid entrapped between the two gears is moved from an inlet to an outlet.

Gears pumps are utilized in a number of applications, and can see temperature challenges due to the stresses and friction which are placed on the pump.

SUMMARY OF THE INVENTION

A gear pump includes a pair of gears having teeth in engagement and received within a housing. The housing defines an inlet and an outlet and has end plates. The gears have shaft portions on each of two sides of each of the two gears. The shaft portions are mounted in journal bearings. The journal bearings each have a gear side face adjacent one of the two gears. A remote face is on a remote side of the journal bearing remote from each of the two gears. There is a plurality of heat pipes in at least one of the journal bearings. The heat pipes move heat from the gear face of the at least one of the journal bearings to the remote face. The plurality of heat pipes is enclosed by the housing, and extend generally in an axial direction from an end adjacent the gear face to an end adjacent the remote face.

A fuel supply system is also disclosed.

These and other features of the present invention can be best understood from the following specification and drawings, the following of which is a brief description.

DETAILED DESCRIPTION

Figure 1:
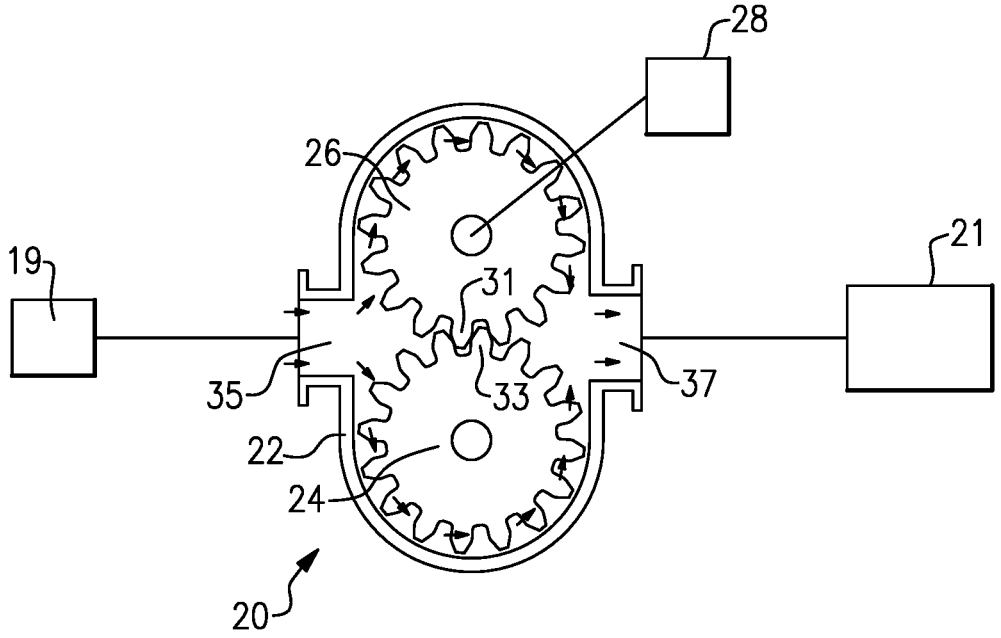
FIG. 1 schematically shows a gear pump.

A gear pump 20 is illustrated in FIG. 1 schematically. As known, a housing 22 defines a pump chamber and surrounds a pair of gears 24 and 26. A motor 28 is shown schematically and may drive the gear 26. Teeth 31 on gear 26 are engaged with teeth 33 on gear 24. The teeth 31 and 33 are engaged, such that when gear 26 rotates (a drive gear) it causes gear 24 (a driven gear) to in turn rotate. As known, the gears 24 and 26 rotate in opposed directions. As the rotation occurs a fluid is moved around the outer periphery of the gears 24 and 26 between an inlet 35 to an outlet 37.

In one embodiment, the gear pump 20 may be utilized to deliver fuel from a fuel tank 19 to a combustor 21, such as may be utilized on a gas turbine engine.

Figure 2A:
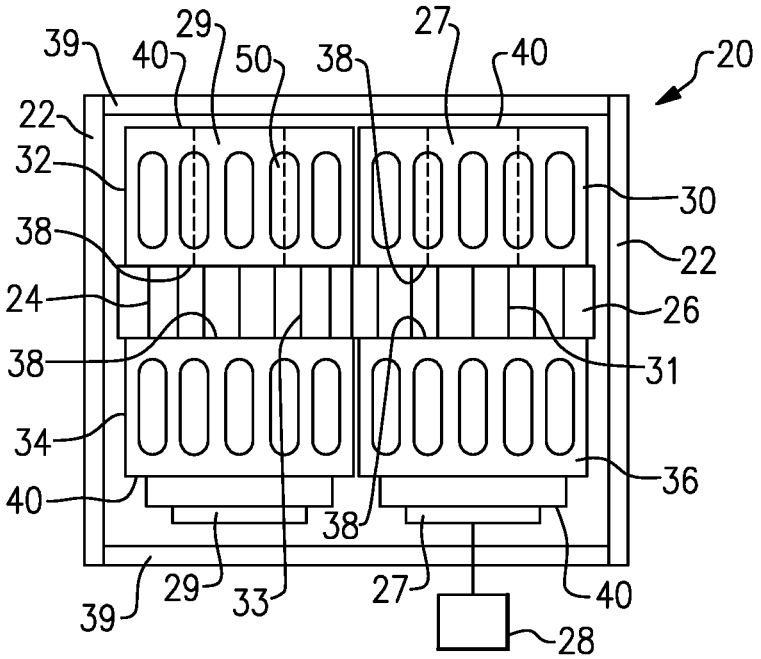
FIG. 2A is a plan view of a gear pump as shown in FIG. 1.

As shown in FIG. 2A, gear 26 has shaft portions 27 mounted in journal bearings 30 and 36, and gear 24 has shaft portions 29 mounted in journal bearings 32 and 34. Each of the journal bearings have a gear face 38 and a remote face 40.

Applicant has recognized that due to the friction exerted as the gears rotate to move fluid, a force is present at the journal bearings 30/32/34/36. As pressures seen by a gear pump increase, this friction force increases. Due to this, Applicant has recognized that there is a temperature difference between the faces 38 and 40 that is significant. The higher temperatures at the gear face 38 can decrease the effective life of the gear pump 20. In addition, the increase in temperature increases a chance of cavitation. When cavitation occurs in a fuel supply system, there can be undesirable impacts.

The housing 22 also includes end plates 39 which, in combination with housing portion 22, enclose the journal bearings 30, 32, 34 and 36, and the gears 24 and 26. As shown, the motor 28 extends outwardly of one of the end plates 39.

Figure 2B:
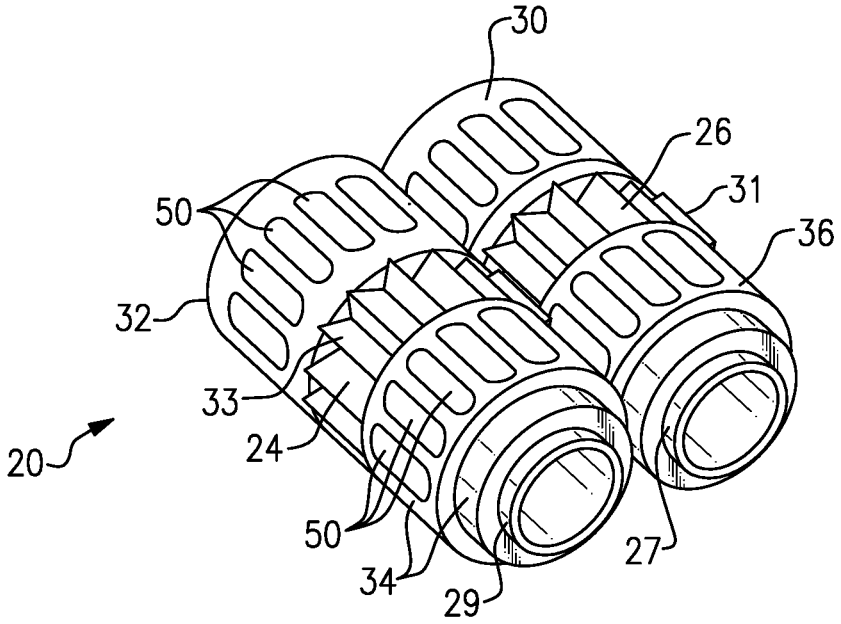
FIG. 2B is a distinct view of the FIG. 2A gear pump.

FIG. 2B is a perspective view of the gear pump 20 showing the gears 24 and 26, and the journal bearings 30/32/34/36. As known, journal bearings are typically a solid item. Now, as shown schematically in FIGS. 2A and 2B, a plurality of cooling circuits 50 are circumferentially spaced about the bearings 30/32/34/36. The cooling circuits 50 may be heat pipes.

Figure 3:
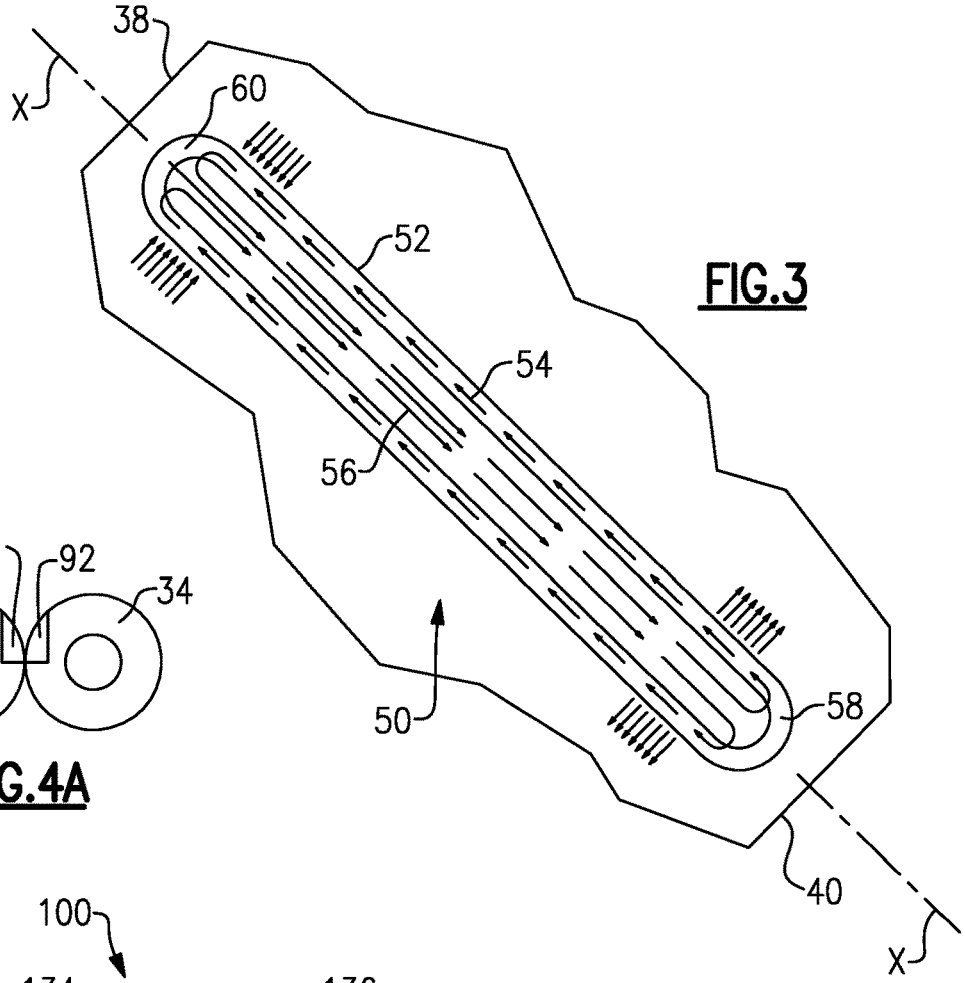
FIG. 3 shows a cooling circuit incorporated into the journal bearings associated with the gear pump.

FIG. 3 shows an example heat pipe 50. As known, a housing 52 defines an outer periphery of the heat pipe 50 and includes a wick 54. There is a refrigerant fluid within the housing 52. There is a hollow chamber 56 inward of the wick 54. The gear side face 38 of one of the journal bearings is illustrated adjacent a hot end 60 of the heat pipe 50. The remote side 40 is shown adjacent a cool side 58. The refrigerant within the heat pipe 50 is in liquid form adjacent end 58, and is moved through the wick 54 in a generally axial direction to drive toward the hot end 60.

At the hot end, the cooler liquid refrigerant in the wick 54 cools the area of the journal bearing adjacent the gear face 38, such that the refrigerant evaporates into a vapor. The vapor leaves the wick and moves into the hollow chamber 56, where it is returned to the cool side 58. The cool side 58 acts as a condenser and cools the vapor and returns it to a liquid state.

The process continues in this way, moving heat from the hot side 60 to the cool side 58, and moving heat from the gear face 38 of the journal bearing to the remote face 40. In this manner, the journal bearings are cooled, and life expectancy is increased. In addition, the risk of cavitation is decreased.

Heat pipes are known, and available from any number of companies. One example heat pipe may be those supplied by Celsia°™. However, other heat pipes can be utilized.

As is clear from FIG. 3, the heat pipes 50 are enclosed within the journal bearing.

Figure 4A:
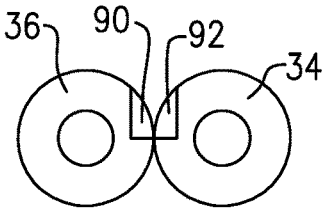
FIG. 4A schematically shows a feature.

FIG. 4A shows a feature with regard to some embodiments of the journal bearings 30/32/34/36. There may be cutouts 90 and 92 on the gear face 38. As can be appreciated, they are distinct between the two illustrated bearings 34 and 36 and there would be similar distinction on the gear faces 38 of the bearings 30 and 32. Thus, it becomes important to ensure that the bearings are not installed in the opposed location. The cutouts are designed to provide a pressure ripple and/or timing characteristics and need to be in their proper position. As can be appreciated, the cutouts 90 and 92 shown here are schematic, and would typically have much more complex shapes.

Figure 4B:
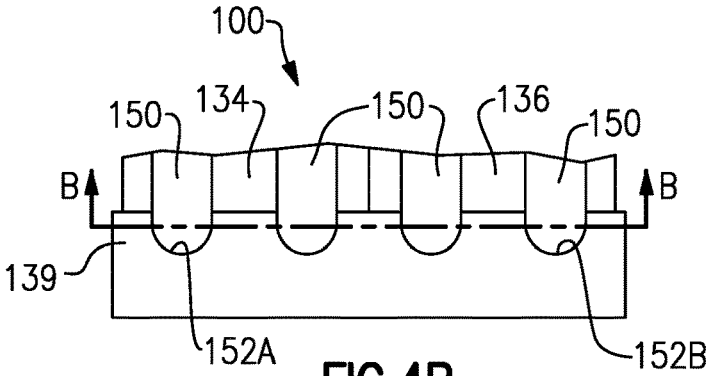
FIG. 4B shows another embodiment.
Figure 4C:
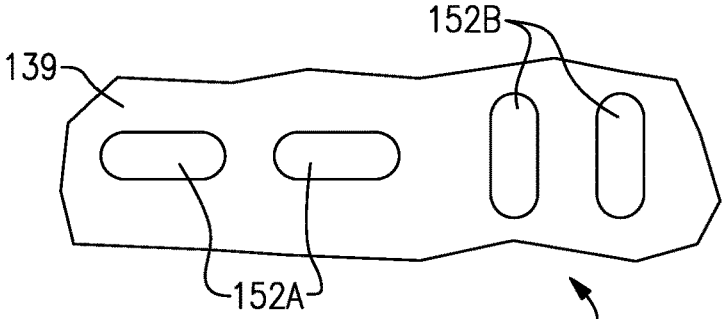
FIG. 4C shows a distinct view of the FIG. 4A embodiment.

FIGS. 4B and 4C show another embodiment 100. In embodiment 100, the condenser end 152 of the heat pipes 150 extends outwardly of the journal bearings 134/136, and into the end plate 139. As shown in FIG. 4B, the ends 152A which are associated with the journal bearing 134 extend at an angle that are distinct relative to the ends 152B associated with journal bearing 136. This ensures proper positioning of the journal bearing within the gear pump.

Because the ends 152A and 152B will only fit into the proper position, the journal bearings will be properly positioned once installed.

By positioning the heat pipe such that they are enclosed within the housing 22/39 or 139, either entirely within the journal bearings (FIG. 3), or ending in the end plate (FIGS. 4A/4B), this disclosure ensures the heat pipes are protected. It should be understood that a fuel pump in a gas turbine engine is in a hostile environment, and having the heat pipes extend outwardly of the housing may raise concerns.

As can be seen, the heat pipe's hot end 60 is axially spaced from the cool end 58, with an axial direction being defined to be parallel to an axis of rotation of the gear 24 or 26. While the heat pipe may be off by a small amount (say five degrees) from directly parallel, it extends generally in an axial direction which is parallel to the axis of rotation of the gears.

As can be seen in FIG. 3, a line X is defined to be parallel to the axes of rotation of gears 24 and 26. The heat pipe extends along an axial direction that is within 10 degrees of the line X, and in embodiments 5 degrees. For purposes of interpreting the claims here, this angular range is what defines "generally axially."

A gear pump under this disclosure could be said to include a pair of gears having teeth in engagement and received within a housing. The housing defines an inlet and an outlet and has end plates. The gears have shaft portions on each of two sides of each of the two gears. The shaft portions are mounted in journal bearings. The journal bearings each have a gear side face adjacent one of the two gears. A remote face is on a remote side of the journal bearing remote from each of the two gears. There is a plurality of heat pipes in at least one of the journal bearings. The heat pipes move heat from the gear face of the at least one of the journal bearings to the remote face. The plurality of heat pipes are enclosed by the housing, and extend generally in an axial direction from an end adjacent the gear face to an end adjacent the remote face.

In one embodiment, the ends of the heat pipes adjacent the remote face are in the journal bearings.

In another embodiment, the ends of the heat pipe adjacent the remote face are in the end plates. In this embodiment, the cool end of the plurality of heat pipes in one of the journal bearings may be at a distinct angular relationship relative to the cool end of the plurality of heat pipes in an adjacent one of the journal bearings.

A gear pump comprising under this disclosure could alternatively be said to include a pair of gears having teeth in engagement and received within a housing. The housing defines an inlet and an outlet and having end plates. The gears have shaft portions on each of two sides of each of the two gears. The shaft portions are mounted in journal bearings. The journal bearings each have a gear side face adjacent one of the two gears, and a remote face on a remote side of the journal bearing remote from each of the two gears. There are cooling means in at least one of the journal bearings. The cooling means moves heat from the gear face of the at least one of the journal bearings to the remote face. The cooling means are enclosed by the housing, and extend generally in an axial direction from an end adjacent the gear face to an end adjacent the remote face.

The cooling means includes a heat pipe.

The heat pipe includes a plurality of heat pipes having a cool end in the housing. The cool ends are at a distinct angular relationship relative to the cool end of an adjacent one of the heat pipes.

Although embodiments of this disclosure have been shown, a worker of ordinary skill in this art would recognize that modifications would come within the scope of this disclosure. For that reason, the following claims should be studied to determine the true scope and content of this disclosure.

What is claimed is:

1. A fuel supply system comprising:

a gear pump for moving fuel from a fuel tank to a combustor of a gas turbine engine;

the gear pump includes:

a pair of gear members having teeth in engagement and received within a housing;

the housing defining an inlet and an outlet and having end plates;

the gears having shaft portions on each of two sides of each of the two gears, the shaft portions being mounted in journal bearings;

the journal bearings each having a gear side face adjacent one of the two gears, and a remote face on a remote side of the journal bearing remote from each of the two gears, and there being a plurality of heat pipes in at least one of the journal bearings, the heat pipes moving heat from the gear face of the at least one of the journal bearings to the remote face;

the plurality of heat pipes being enclosed by the housing, and extending generally in an axial direction from an end adjacent the gear face to an end adjacent the remote face; and wherein the heat pipe includes an outer housing enclosing a wick, a chamber within the wick, and a refrigerant fluid, wherein the wick moving the refrigerant in a liquid phase from a cool end of the heat pump adjacent the remote face in a direction toward a hot end of the heat pump adjacent the gear face, such that the liquid phase refrigerant is heated at the hot end and evaporates into a vapor state, and moves through the chamber in a direction towards the cool side, and the vapor phase refrigerant is cooled at the cool side to a liquid state such that the refrigerant circulates from the cool side to the hot side to move the heat from the gear face of the journal bearing to the remote face of the journal bearing.

2. The fuel supply system as set forth in claim 1, wherein each of the journal bearings have a plurality of circumferentially spaced heat pipes.

3. The fuel supply system as set forth in claim 2, wherein a motor drives one of the two gears, and the engaged gear teeth of the drive one of the two gears in turn causing the other the two gears to be driven as a driven gear.

4. The fuel supply system as set forth in claim 1, wherein the cool end of the plurality of heat pipes is in the journal bearings.

5. The fuel supply system as set forth in claim 1, wherein the cool end of the plurality of heat pipes is in the end plates.

6. The fuel supply system as set forth in claim 5, A fuel supply system comprising:

a gear pump for moving fuel from a fuel tank to a combustor of a gas turbine engine;

the gear pump includes:

a pair of gear members having teeth in engagement and received within a housing;

the housing defining an inlet and an outlet and having end plates;

the gears having shaft portions on each of two sides of each of the two gears, the shaft portions being mounted in journal bearings;

the journal bearings each having a gear side face adjacent one of the two gears, and a remote face on a remote side of the journal bearing remote from each of the two gears, and there being a plurality of heat pipes in at least one of the journal bearings, the heat pipes moving heat from the gear face of the at least one of the journal bearings to the remote face; and the plurality of heat pipes being enclosed by the housing, and extending generally in an axial direction from an end adjacent the gear face to an end adjacent the remote face;

wherein the cool end of the plurality of heat pipes is in the end plates; and wherein the cool end of the plurality of heat pipes in onea first of the journal bearings are at a distinct angular relationship relative to the cool end of the plurality of heat pipes in an adjacent a second of the journal bearings, to ensure proper positioning in each of the first journal bearing and the second journal bearing.

7. The fuel supply system as set forth in claim 9claim 6, wherein the heat pipe includes an outer housing enclosing a wick, a chamber within the wick, and a refrigerant fluid.

8. The fuel supply system as set forth in claim 7, wherein the wick moving the refrigerant in a liquid phase from a cool end of the heat pump adjacent the remote face in a direction toward a hot end of the heat pump adjacent the gear face, such that the liquid phase refrigerant is heated at the hot end and evaporates into a vapor state, and moves through the chamber in a direction towards the cool side, and the vapor phase refrigerant is cooled at the cool side to a liquid state such that the refrigerant circulates from the cool side to the hot side to move the heat from the gear face of the journal bearing to the remote face of the journal bearing.

* * * * *